United States Patent [19]

Pluequet

[11] 4,331,112

[45] May 25, 1982

[54] LUBRICATING ARRANGEMENT, ESPECIALLY FOR INTERNAL COMBUSTION ENGINES

[75] Inventor: Heinz Pluequet, Cologne, Fed. Rep. of Germany

[73] Assignee: Klöckner-Humboldt-Deutz Aktiengesellschaft, Cologne, Fed. Rep. of Germany

[21] Appl. No.: 81,215

[22] Filed: Oct. 2, 1979

[30] Foreign Application Priority Data

Oct. 4, 1978 [DE] Fed. Rep. of Germany ..... 2843248

[51] Int. Cl.[3] ..... F02B 33/40

[52] U.S. Cl. ..... 123/196 S; 60/605; 184/6.3

[58] Field of Search ..... 123/196 S, 196 R; 184/6.3, 6.4; 60/605, 39.08

[56] References Cited

U.S. PATENT DOCUMENTS 3,045,420 7/1962 Addie et al. ..... 60/605
3,057,436 10/1962 Jacobson et al. ..... 184/6.3
4,126,997 11/1978 Henson ..... 184/6.3 X
4,157,744 6/1979 Capriotti ..... 123/196 S X

FOREIGN PATENT DOCUMENTS 347848 5/1931 United Kingdom ..... 184/6.3

*Primary Examiner*—Tony M. Argenbright
*Attorney, Agent, or Firm*—Becker & Becker, Inc.

[57] ABSTRACT

An arrangement for lubricating, especially for internal combustion engines is disclosed. The circuit of the arrangement is fed with the lubricating medium, e.g. oil, by means of a pump which delivers oil from a source, as required through an oil cooler and a filter, to bearings of the engine which require lubrication, and to more remote bearings, such as are used in auxiliary equipment, e.g. off-gas turbo-superchargers. In the main pressure conduit, relatively close to the pump, there is provided a flow control device with a direct conduit being provided to communicate the pump with the more remote bearings. The direct conduit is connected to the circuit between the pump and the flow control device. As required, an oil filter can be arranged in the direct conduit. The flow control device is controlled by the fluid pressure prevailing in front thereof to open and is spring biased to close, with a further conduit also connected to the circuit between the pump and the flow control device, communicating the pump and the flow control device.

8 Claims, 1 Drawing Figure

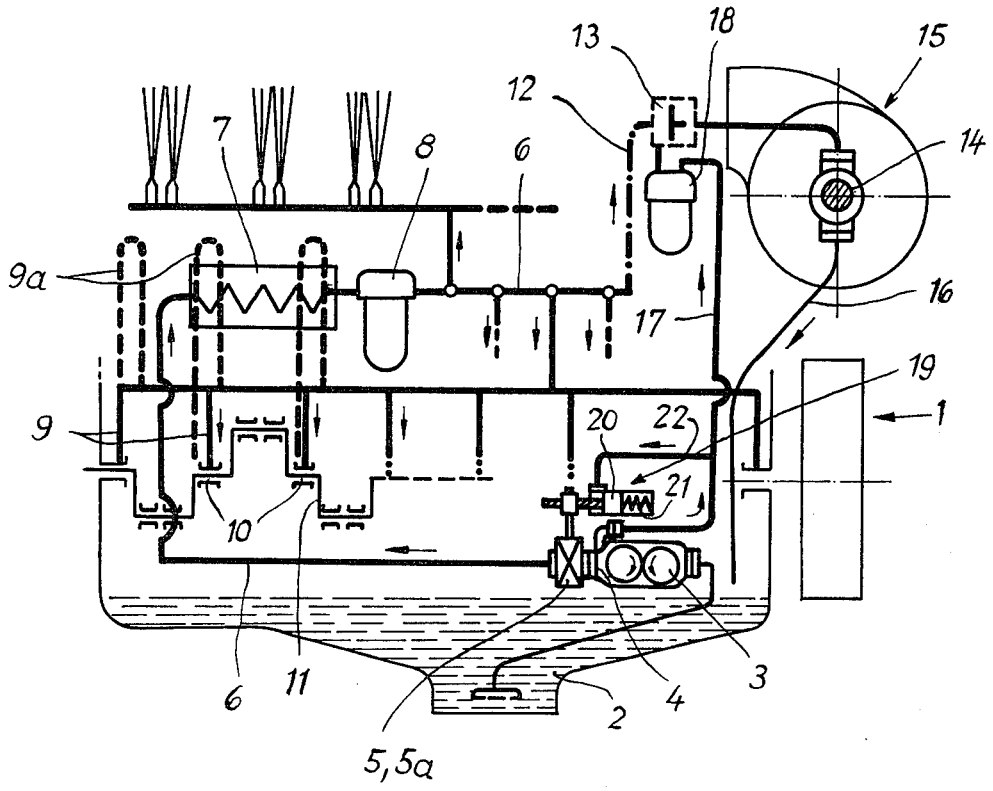
13
18
15
12
14
7
8
6
9a
16
17
19
1
9
20
22
21
10
6
11
2
4
3
5,5a

LUBRICATING ARRANGEMENT, ESPECIALLY FOR INTERNAL COMBUSTION ENGINES

The present invention relates to a lubricating arrangement, especially for internal combustion engines with at least one first location requiring lubrication, and at least one second location requiring lubrication, e.g. in an auxiliary equipment associated with said engine. The circuit includes a pump device adapted to convey or move the lubricating medium, e.g. oil, through a main conduit means to the locations requiring lubrication.

It is known to connect auxiliary equipment, such as for example the (exhaust) turbo-supercharger, by means of a connecting conduit to the main pressure conduit of the internal combustion engine. It is also known to arrange a drain conduit between the turbo-supercharger and the oil sump. The connecting conduit, due to the required cooling and filtering of the oil which is admitted during operation of the engine, is connected to the main pressure conduit, when viewed in the direction of flow of the lubricating oil, at a point behind the oil cooler and the oil filter, and behind other parts of the system, such as the feed-in conduits and so forth. When the engine is not operated for lengthy periods of time, the oil drains from the spaces, either in part of entirely. Thus, on restarting of the engine these spaces have to be filled again before the full oil pressure has been re-established to move the oil to the pertaining bearing locations which require lubrication. Particularly detrimentally affected are the further removed bearing locations of auxiliary equipment, for example the bearing locations of a turbo-supercharger, which are usually arranged to be at the level of the upper edge of the engine, or still further thereabove. At times, the oil is admitted to these bearing locations at a sufficient pressure after such a period of time that this delay is not of detriment at no-load running, or run-up, and correspondingly delayed, or gradual, transfer of load of the engine. However, for rapid transfer of the load as it will be the case in equipment to be operationally available at least nearly instantaneously, the point in time at which the pressure oil or lubricating oil is available in a sufficient volume will be unacceptably delayed. This can lead to serious damage and even to destruction of such bearing locations, unless by means of extensive lubricating devices it would be assured that a continuous or intermittent supply of lubricating oil is available. For most situations, however, such devices are too excessive, so that they can only be considered for larger systems.

It is accordingly an object of the present invention to provide an arrangement for lubricating so that the supply of the lubricating medium, or oil, for the more remote bearing locations is attained early enough and so that lubrication of such locations is attained by simple, yet effective means without detriment to the lubrication circuit.

These objects and other objects and advantages of the invention will appear more clearly from the following specification in connection with the accompanying drawings, in which:

The single FIGURE diagrammatically indicates a lubricating circuit which includes features in accordance with the invention.

The arrangement for lubricating, especially for internal combustion engines, is characterized primarily therein that in the main pressure conduit, as close as possible to the pump device, there is arranged an adjustable throttle, throttle valve, or similar flow control means, and that between the flow control means and the pump device there is connected a direct pressure conduit leading, as required with interpositioning of a filter for the lubricating medium, which filter is positioned so as to be substantially drain-proof, to the more remote or second bearing locations. Furthermore, the flow control means, more particularly the actuating mechanism thereof, is connectible to a control conduit which can be subjected to the pressure which prevails in the conduit between the pump and the flow control device, for opening the flow control device which is inherently urged to its closing position by a biasing spring.

Thus, by means of the direct pressure conduit connected to the pump device, or to the main pressure conduit at a connection point closely behind the pump device when viewed in the flow direction, of the bearing locations, as required by interpositioning of a filter for the lubricating medium, which is positioned to be substantially drain-proof, lubricant will be immediately supplied to these bearing locations.

In order that the lubricant is forced through the direct pressure conduit at the initial rotations of the pump device, e.g. a lubricating oil pump, and would not select the lesser resistance of the replenishing process of the main pressure conduit, draining towards the main pressure conduit, in accordance with the prevailing conditions, can be delayed for a short period of time, or interrupted, as required, by means of the adjustable throttle, or similar control device, whereby the confluence to the main pressure conduit is fully attained with the oil pressure building up via the control conduit. After turning the engine off, however, the flow control device is moved to its closed position due to its resiliently biasing spring.

In accordance with a preferred embodiment of the invention, the control conduit of the system is connected to the direct pressure conduit which affords a constructively simple and economical arrangement of the control conduit.

In accordance with another embodiment of the invention, there is provided an arrangement wherein the direct pressure conduit leads to a connecting conduit. This connecting conduit extends between the main pressure conduit and the more remote bearing locations and a switch valve is connected to the direct pressure conduit and the connecting conduit. This valve can be actuated such that at a predetermined pressure of the lubricant in said connecting conduit, the switch valve terminates the flow of lubricant through the direct pressure conduit, whereby the connecting conduit is solely adapted to convey lubricant to the more remote bearing locations; and at a predetermined low pressure of the lubricant, the valve terminates the flow of lubricant through the connecting conduit, whereby the direct pressure conduit is then adapted to solely convey lubricant to the more remote bearing locations.

Such an arrangement will ensure that only during starting of the engine the supply of the more remote bearing locations with lubricant is effected solely by the direct pressure conduit, whereby after attaining the required speed and on attaining sufficient pressure in the main pressure conduit, the lubricant supply is provided through the latter. This will ensure that during normal operation of the engine all bearing locations are supplied with cooled, and as required, by filtered lubricant. When the volume of lubricating medium flowing through the direct pressure line is relatively small and when the more remote bearing locations can be subjected to a somewhat warmer not re-cooled lubricating medium, heated due to operation of the motor, the direct pressure conduit can be used to feed the lubricant during the entire operation of the motor, and the usual connecting conduit between the main pressure conduit and the bearing locations can be avoided.

In accordance with another preferred embodiment of the invention, in the main pressure conduit there is arranged, as close as possible to the pump device, an adjustable flow control device. This flow control device is urged to its closed position by a spring, and is adapted to be actuated to assume its open position by the pressure prevailing in the main pressure conduit between it and the pump device. The means for cooling oil, the means for filtering oil, other spaces, the main pressure conduit with side chambers, and at least short sections of feeder lines are all arranged in relation to the at least one first bearing location requiring lubrication so as to be substantially drain-proof. Thus, when the bearing locations are drain-proof, the lubricant, i.e. oil, could return only through the main pressure conduit; however, this is prevented by the flow control device. Drain-proofing can be assured thereby that at least short sections of the feeder lines of the main pressure conduit and the pertaining side chambers and the like leading to the bearing locations, are arranged so that the highest point thereof is higher than all other chambers or the like spaces of the system. Thus, even when then the connecting conduit leading from the main pressure conduit to the more remote bearing locations, for example of the super-turbocharger, should have become drained due to lower lying bearing locations, nevertheless, due to the oil pressure which is building up when the flow control device is opened and due to the filled oil spaces, the increase of pressure in the connecting conduit would be carried out as rapidly as the case would be if a direct pressure conduit were employed.

Referring now particularly to the single FIGURE of the drawing, the numeral 1 designates a diagrammatically indicated combustion engine. Engine 1 has an oil sump 2 from which oil or a similar lubricating medium can be brought into a conduit 6 by means of a pump 3. At the output or pressure end 4 of the pump 3 there is arranged a throttle, valve or other similar flow control device, designated by a numeral 5, which is also operatively connected to the conduit 6, this conduit also being referred to as main pressure conduit. As required, a means for cooling oil 7, and a means for filtering oil, such as filter 8, are arranged in the conduit 6. Feeder lines 9 are in communication with the conduit 6, which feeder lines 9 lead to bearing locations 10, also referred to as first, or bearing, locations requiring lubrication. The bearings 10 are provided for a crank shaft 11 and other similar parts. The main conduit 6 is furthermore in communication with a connecting conduit 12 which is adapted to bring the oil to more remote bearing locations, also referred to as second, or bearing, locations requiring lubrication, generally designated by numeral 14 of an auxiliary equipment, e.g. a turbo-supercharger 15.

A drain conduit 16 leads from the remote bearing location 14 to the sump 2. A direct pressure conduit 17 is connected to the output end 4 of pump 3, which conduit 17 leads to a switch valve or similar flow control device, generally designated by the numeral 13 and connected in the connecting conduit 12. As required, a filter 18 can be provided in conduit 17, which filter is located so as to be substantially drain-proof. The flow control device 13 is adapted to be actuated so that when the connecting conduit 12 is pressurized, i.e. when the oil is moving towards the remote bearing locations 14, it is open, while at low pressure, or no pressure in this connecting conduit 12, the valve 13 closes this conduit 12. This latter condition is indicated in the drawing. The direct pressure conduit 17 then feeds the lubricating medium to the more remote bearing locations 14.

The flow control device 5 is actuated by means of an auxiliary cylinder 19 having a piston 20. The piston 20 is biased by a spring 21 on the one hand, and by means of a control conduit 22 by the pressure in the direct conduit 17 on the other hand, so that when conduit 17 is pressureless, or when a low pressure exists in the direct conduit 17, the flow control device 5 is closed, while a sufficient pressure in conduit 17 will serve to open the flow control device 5.

The drawing further indicates in dot-dash outline feeder lines **9*a* for three first bearing locations 10 of the crank shaft 11. These feeder lines 9*a* are arranged so that each includes a section which is located higher than the main pressure conduit with side chambers and the like. Thus, when use is made of such feeder lines 9*a* and of a flow control device 5*a*, the direct pressure conduit 17** need not be employed.

The present invention is, of course, in no way restricted to the specific disclosure of the specification and drawing, but also encompasses any modifications within the scope of the appended claims.

What I claim is:

1. A lubricating arrangement, especially for internal combustion engines with at least one first location requiring lubrication, and at least one second location requiring lubrication in an auxiliary equipment associated with said engine, said at least one second location being remote from said at least one first location, said arrangement comprising:

a main conduit means for communicating said at least one first location and said at least one second location with a source of lubricating medium, said main conduit means including a main pressure conduit;

a pump device operatively connectible to said main conduit means and adapted to convey a lubricating medium from said source thereof to said at least one first location and said at least one second location;

a flow control device operatively connectible to said main pressure conduit, close to said pump device between said pump device and said at least one first location, said flow control device being inherently urged to its closed position and being actuatable to assume an open position by the pressure in said main pressure conduit between it and said pump device, a direct pressure conduit, operatively connectible between said pump device and said flow control device, for conveying said lubricating medium to said at least one second location requiring lubrication, said main conduit means including a connecting conduit connectible to said main pressure conduit and said direct pressure conduit at a common point for conveying lubricating medium to said at least one second location, and further comprising:

a switch valve device operatively connectible to said connecting conduit at said common point, said switch valve device being adapted to be actuated by lubricating medium pressure in said main pressure conduit such that:

(a) at a predetermined low pressure said switch valve terminates the flow of lubricating medium from said main pressure conduit through said connecting conduit, whereby said direct pressure conduit is adapted to convey said lubricating medium to said at least one second location, and (b) at a predetermined pressure of said lubricating medium in said connecting conduit said switch valve terminates the flow of lubricating medium through said direct pressure conduit, whereby said connecting conduit is adapted to convey lubricating medium from said main pressure conduit to said at least one second location requiring lubrication.

2. A lubricating arrangement in combination according to claim 1, and further comprising means, operatively connectible to said main pressure conduit, for cooling said lubricating medium, and means operatively connectible to said main pressure conduit, for filtering said lubricating medium.

3. A lubricating arrangement in combination according to claim 2, wherein at least said main pressure conduit, said cooling means, and said filtering means are positioned substantially drain-proof in relation to said at least one first location requiring lubrication so as to be continuously effectively filled with lubricating medium.

4. A lubricating arrangement in combination according to claim 3, wherein said main pressure conduit includes side chambers, and wherein between said main pressure conduit and said at least one first location requiring lubrication there is provided at least one feeder line, with at least an effective portion of said at least one line close to said first location being arranged higher than said main pressure conduit.

5. A lubricating arrangement according to claim 1, and including a means for filtering said lubricating medium, said filtering means being operatively connectible to said direct pressure conduit.

6. A lubricating arrangement according to claim 5, wherein said filtering means is positioned so as to be continuously filled with said lubricating medium.

7. A lubricating arrangement according to claim 1, and including a control conduit operatively connectible to the pertaining actuating mechanism of said flow control device to effect an opening thereof.

8. A lubricating arrangement according to claim 7, wherein said control conduit is operatively connected to said direct pressure conduit.

* * * * *